US005907313A

United States Patent [19]

Kubota et al.

[11] Patent Number: 5,907,313

[45] **Date of Patent: *May 25, 1999**

[54] MATRIX-TYPE DISPLAY DEVICE

[75] Inventors: Yasushi Kubota, Nara; Kenichi Katoh, Hiroshima; Hidehiko Chimura, Nagano; Jun Koyama, Kanagawa, all of Japan

[73] Assignees: Semiconductor Energy Laboratory Co., Ltd., Kanagawa-ken; Sharp Kabushiki Kaisha, Osaka, both of Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/743,990

[22] Filed: Nov. 5, 1996

[30] Foreign Application Priority Data

Nov. 6, 1995 [JP] Japan ..... 7-311606

[51] Int. Cl.[6] ..... G09G 3/36

[52] U.S. Cl. ..... 345/100; 345/211; 345/99

[58] Field of Search ..... 345/100, 205, 345/206, 211, 99

[56] References Cited

U.S. PATENT DOCUMENTS

| | | | |
|---|---|---|---|
| 4,963,860 | 10/1990 | Stewart | 345/206 |
| 5,051,739 | 9/1991 | Hayashida et al. | 345/206 |
| 5,250,931 | 10/1993 | Misawa et al. | 345/92 |
| 5,555,001 | 9/1996 | Lee et al. | 345/93 |
| 5,563,624 | 10/1996 | Imamura | 345/100 |
| 5,574,475 | 11/1996 | Callahan, Jr. et al. | 345/100 |
| 5,585,816 | 12/1996 | Scheffer et al. | 345/100 |
| 5,598,180 | 1/1997 | Suzuki et al. | 345/100 |
| 5,703,616 | 12/1997 | Kawasugi | 345/98 |

*Primary Examiner*—Amare Mengistu
*Assistant Examiner*—Ricardo Osorio
*Attorney, Agent, or Firm*—Fish & Richardson P.C.

[57] ABSTRACT

A matrix-type display device in which a number of pixels are arranged and a scanning line and a signal line to which a display signal is output are connected to each pixel. A signal line driver circuit in which a decoder circuit is controlled by a counter circuit, or a scanning line driver circuit in which a decoder circuit is controlled by a counter circuit is divided into a plurality of sections. A clock signal and/or a power supply voltage is selectively supplied to the respective sections.

14 Claims, 13 Drawing Sheets

MATRIX-TYPE DISPLAY DEVICE

BACKGROUND OF THE INVENTION

1. Field of the Invention

The present invention relates to a matrix-type display device and, more specifically, to a matrix-type display device with low power consumption.

2. Description of the Related Art

In active matrix display devices, the driver circuits generally employ shift registers or decoder circuits. This specification will describe the case of using decoder circuits.

FIG. 15 shows the configuration of an example of a conventional matrix-type display device. This matrix-type display device in FIG. 15 consists of a signal line counter 1501, a signal line decoder 1502, a signal line sampling circuit 1503, a scanning line counter 1504, a scanning line decoder 1505, and an m-row/n-column pixel matrix portion 1506.

To produce m or more different binary outputs, the signal line counter 1501 is composed of counter circuits of i stages (i satisfies 2i>m) that operate in synchronism with a signal line clock signal 1507 (see FIG. 3)

To produce n or more different binary outputs, the scanning line counter 1504 is composed of counter circuits of j stages (j satisfies 2j>n) that operates in synchronism with a scanning line clock signal 1508 (see FIG. 3).

The signal line decoder 1502 is a logic circuit that is so constructed as to select a particular signal line in response to an output of the signal line counter 1501.

The scanning line decoder 1505 is a logic circuit that is so constructed as to select a particular scanning line in response to an output of the scanning line counter 1504.

The signal line sampling circuit 1503 is a switching circuit that outputs, in synchronism with a pixel signal 1509, a display signal to pixels selected by an output of the signal line decoder 1502.

In the pixel matrix portion 1506, pixels (see FIG. 6) are arranged in matrix form on a plane. FIG. 6 shows a circuit configuration of each pixel. In FIG. 6, reference numerals 601 and 602 denote a scanning line and a signal line, respectively. Each pixel consists of a liquid crystal element 604, an auxiliary capacitor 605, and an n-channel thin-film transistor 603 whose gate receives an output of the scanning line decoder 1505 and source receives an output of the signal line sampling circuit 1503.

The operation of the conventional matrix-type display device will be described below.

First, a description will be made of an operation of displaying one line, that is, pixels connected to a single output line of the scanning line decoder 1505.

Attention is paid to the k-th line from the top in the vertical direction (hereinafter referred to simply as "k-th line"). When the output of the scanning line decoder 1505 for the k-th line turns a high potential (hereinafter abbreviated as "H"), the gate electrodes of all the k-th line pixels receive "H" and hence source-drain conduction is established in all the n-channel thin-film transistors of the k-th line.

During the course of the above operation, as the signal counter 1501 counts up in response to the signal line clock signal 1507, signal lines are sequentially selected from the left-side end of the k-th line by the signal line decoder 1502 and a video signal is sampled by the signal line sampling circuit 1503. Thus, display signals are sequentially written to the respective pixels, that is, a one-line writing operation is finished.

Next, a description will be made of an operation of displaying one frame.

As the scanning line counter 1504 counts up in synchronism with the scanning line clock signal 1508, scanning lines are sequentially selected from the top of one frame by the scanning line decoder 1505 and are given an output "H." The above-described one-line display is effected when the gate signal of each line is "H." One frame is displayed in this manner.

As described above, in the conventional matrix-type display device, as the number of signal lines of the signal line counter 1501 or the number of scanning lines of the scanning line counter 1504 increases, the number of flip-flop circuits in the counter circuits in which the holding signal varies in synchronism with each one-period clock decreases.

FIGS. 5A and 5B show the configuration of a flip-flop circuit. In FIGS. 5A and 5B, reference numeral 501 denotes a flip-flop circuit; 502, an inverted clock input line; 503, a clock input line; 504, a data input line; 505, an output line; and 506, an inverted output line.

In the above situation, the clock line capacitance, which is the clock line wiring capacitance plus the capacitance of elements that are connected to the clock lines, may cause a problem. The clock line capacitance is charged and discharged every time the clock signal to the counter circuits varies, and therefore consumes power even when there is no variation in the holding signal.

If it is prevented that a clock is input to circuit portions the inventors recognized that preventing the clock from being input to the circuit portions consumption due to the existence of the clock line capacitance could be reduced as much and hence the amount of heat generation could also be reduced.

Further, the elements are always supplied with a power supply voltage and leak current occurs therein. This is another factor of undue power consumption. If it is prevented that a power supply voltage is supplied to circuit portions where no variation occurs in the holding signal or the output signal, the power consumption due to leak current could be reduced as much and the amount of heat generation could also be reduced.

SUMMARY OF THE INVENTION

An object of the present invention is to reduce the power consumption and the amount of heat generation during operation of a matrix-type display device.

To attain the above object, according to a first aspect of the invention, there is provided a matrix-type display device comprising pixels arranged in matrix form; scanning lines for supplying scanning signals to the respective pixels; signal lines for supplying display signals to the respective pixels; a scanning line driver circuit connected to the scanning lines; a signal line driver circuit connected to the signal lines, at least one of the scanning line driver circuit and the signal line driver circuit being divided into a plurality of sectional circuits; and selection means for selectively supplying a clock signal to the respective sectional circuits.

In the above matrix-type display device, the divided signal line driver circuit may comprise a decoder circuit for selecting among the signal lines and a counter circuit for controlling the decoder circuit, each of the decoder circuit and the counter circuit being divided to constitute the sectional circuits.

In the above matrix-type display device, the divided scanning line driver circuit may comprise a decoder circuit for selecting among the scanning lines and a counter circuit for controlling the decoder circuit, each of the decoder circuit and the counter circuit being divided to constitute the sectional circuits.

The above matrix-type display device may further comprise a select signal generation circuit for supplying a select signal to the selection means, and the select signal generation circuit, the scanning line driver circuit, and the signal line driver circuit may be formed on the same substrate as the pixels by using thin-film transistors.

According to a second aspect of the invention, there is provided a matrix-type display device comprising pixels arranged in matrix form; scanning lines for supplying scanning signals to the respective pixels; signal lines for supplying display signals to the respective pixels; a scanning line driver circuit connected to the scanning lines; a signal line driver circuit connected to the signal lines, at least one of the scanning line driver circuit and the signal line driver circuit being divided into a plurality of sectional circuits; and selection means for selectively supplying a power supply voltage to the respective sectional circuits.

In the above matrix-type display device, the divided signal line driver circuit may comprise a decoder circuit for selecting among the signal lines, a counter circuit for controlling the decoder circuit, and a sampling circuit for sampling a video signal and outputting a display signal to pixels selected by the decoder circuit, each of the decoder circuit, the counter circuit, and the sampling circuit being divided to constitute the sectional circuits.

In the above matrix-type display device, the divided scanning line driver circuit may comprise a decoder circuit for selecting among the scanning lines and a counter circuit for controlling the decoder circuit, each of the decoder circuit and the counter circuit being divided to constitute the sectional circuits.

The above matrix-type display device may further comprise a select signal generation circuit for supplying a select signal to the selection means, and the select signal generation circuit, the scanning line driver circuit, and the signal line driver circuit may be formed on the same substrate as the pixels by using thin-film transistors.

According to a third aspect of the invention, there is provided a matrix-type display device comprising pixels arranged in matrix form; scanning lines for supplying scanning signals to the respective pixels; signal lines for supplying display signals to the respective pixels; a scanning line driver circuit connected to the scanning lines; a signal line driver circuit connected to the signal lines, at least one of the scanning line driver circuit and the signal line driver circuit being divided into a plurality of sectional circuits; first selection means for selectively supplying a clock signal to the respective sectional circuits; and second selection means for selectively supplying a power supply voltage to the respective sectional circuits.

In the above matrix-type display device, the divided signal line driver circuit may comprise a decoder circuit for selecting among the signal lines, a counter circuit for controlling the decoder circuit, and a sampling circuit for sampling a video signal and outputting a display signal to pixels selected by the decoder circuit, each of the decoder circuit, the counter circuit, and the sampling circuit being divided to constitute the sectional circuits.

In the above matrix-type display device, the divided scanning line driver circuit may comprise a decoder circuit for selecting among the scanning lines and a counter circuit for controlling the decoder circuit, each of the decoder circuit and the counter circuit being divided to constitute the sectional circuits.

In the above matrix-type display device may further comprise a select signal generation circuit for supplying select signals to the first and second selection means, and the select signal generation circuit, the scanning line driver circuit, and the signal line driver circuit may be formed on the same substrate as the pixels by using thin-film transistors.

According to a fourth aspect of the invention, there is provided a matrix-type display device comprising pixels arranged in matrix form; scanning lines to the respective pixels; signal lines for supplying display signals to the respective pixels; signal line driver circuits or scanning line driver circuits are constituted by a plurality of series-connected unit circuits, wherein an output of one or ones of the plurality of unit circuits controls a data input, a clock input, or a power input to other one of ones of the plurality of unit circuits.

In the above matrix-type display device, the signal line driver circuit or the scanning line driver circuit may be constructed such that a counter circuit controls a decoder circuit.

According to a fifth aspect of the invention, there is provided a matrix-type display device comprising pixels arranged in matrix form; scanning lines to the respective pixels; signal lines for supplying display signals to the respective pixels; a scanning line driver circuit connected to the scanning lines; a signal line driver circuit connected to the signal lines, at least one of the scanning line driver circuit and the signal line driver circuit being divided into a plurality of series-connected unit circuits as well as into a plurality of sectional circuits; and selection means for selectively supplying a clock signal or a power voltage to respective sectional circuits, wherein an output of one or ones of the plurality of unit circuits controls a data input, a clock input, or a power input to other one of ones of the plurality of unit circuits.

In the above matrix-type display device, the signal line driver circuit or the scanning line driver circuit may be constructed such that a counter circuit controls a decoder circuit.

In the above matrix-type display device, the scanning line driver circuit, the signal line driver circuit, and the selectional circuits may be formed on the same substrate as the pixels by using thin-film transistors.

As described above, in the invention, at least one of the scanning line driver circuit and the signal line driver circuit is divided into a plurality of sectional circuits and a clock signal is selectively supplied to the respective sectional circuits. Therefore, it can be prevented that a clock signal is supplied to sectional circuits where no variation occurs in the holding signal. As a result, the power consumption due to the existence of the clock line capacitance can be reduced as much and hence the amount of heat generation can also be reduced.

Further, in the invention, at least one of the scanning line driver circuit and the signal line driver circuit is divided into a plurality of sectional circuits and a power signal is selectively supplied to the respective sectional circuits. Therefore, it can be prevented that a power supply voltage is supplied to sectional circuits where no variation occurs in the holding signal or the output signal. As a result, the power consumption due to leak current can be reduced as much and the amount of heat generation can also be reduced.

DETAILED DESCRIPTION OF THE PREFERRED EMBODIMENTS

Embodiments of the present invention will be hereinafter described in detail with reference to the accompanying drawings.

Embodiment 1

Figure 1:
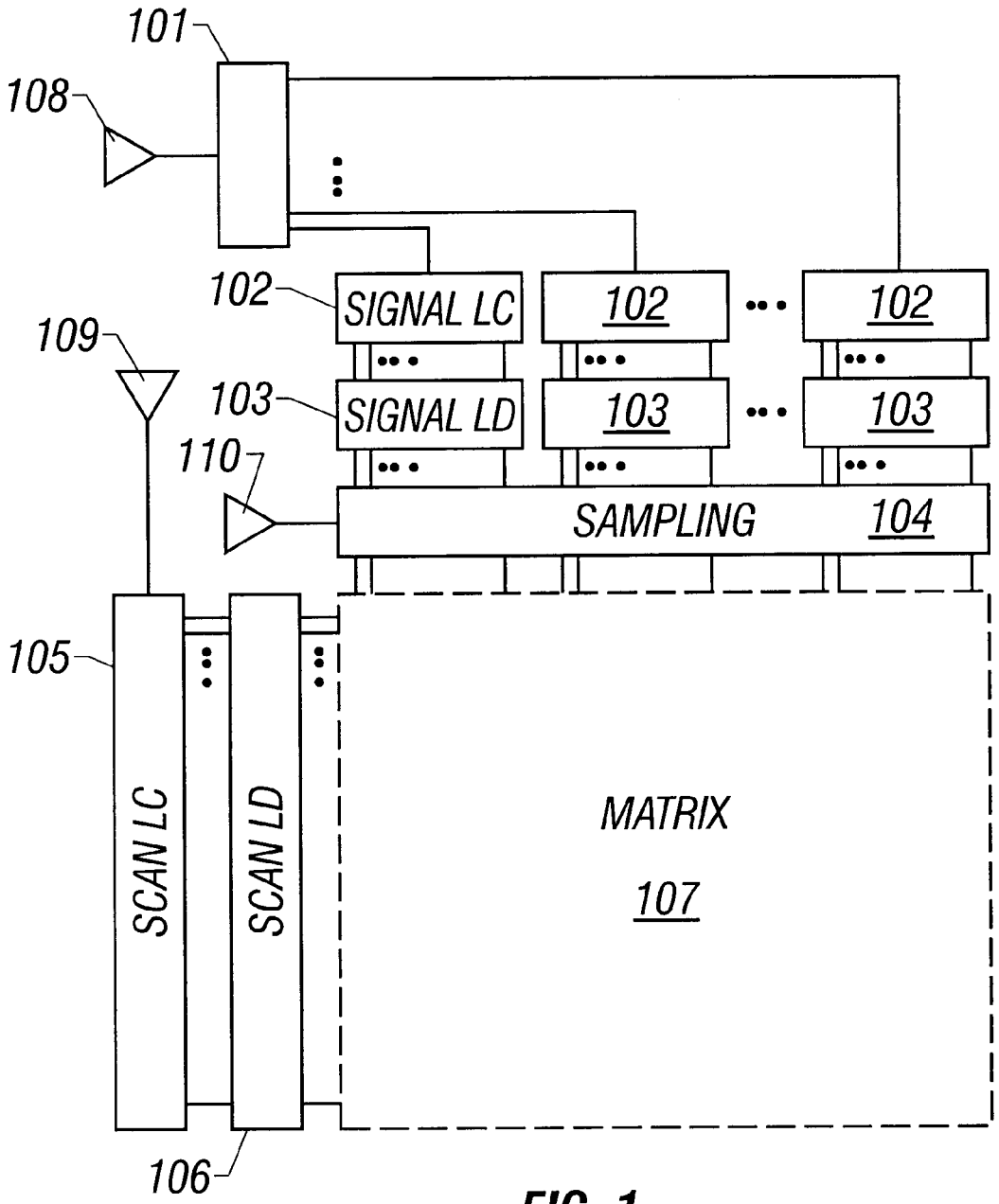
FIG. 1 shows the configuration of a matrix-type display device according to a first embodiment of the present invention.

FIG. 1 shows the configuration of a matrix-type display device according to a first embodiment of the invention.

First, the configuration will be described. The matrix-type display device of the first embodiment has an active matrix of m-row/n-column pixels.

Figure 6:
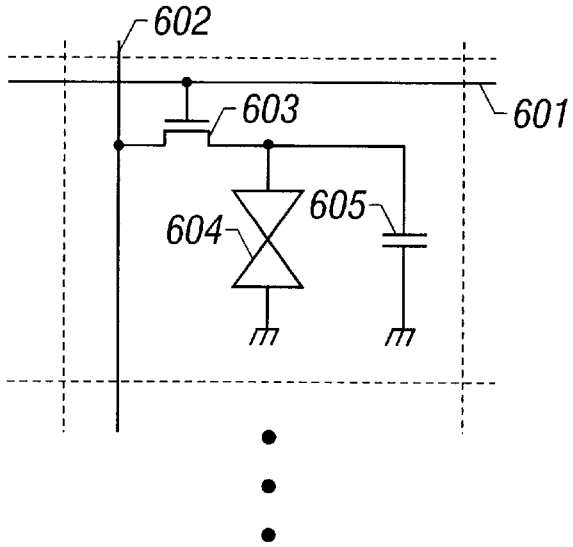
FIG. 6 shows a circuit configuration of each pixel.

Like the conventional device, the matrix-type display device of this embodiment consists of a signal line counter 102, a signal line decoder 103, a signal line sampling circuit 104, a scanning line counter 105, a scanning line decoder 106, and an m-row/n-column pixel matrix portion 107. Like the conventional device, each pixel is constructed as shown in FIG. 6. The scanning line counter 105 is composed of counter circuits of j stages ($2j \geqq n$) that operate in synchronism with a scanning line clock signal 109 (see FIG. 3), and output j count signals to the scanning line decoder 106.

Figure 3:
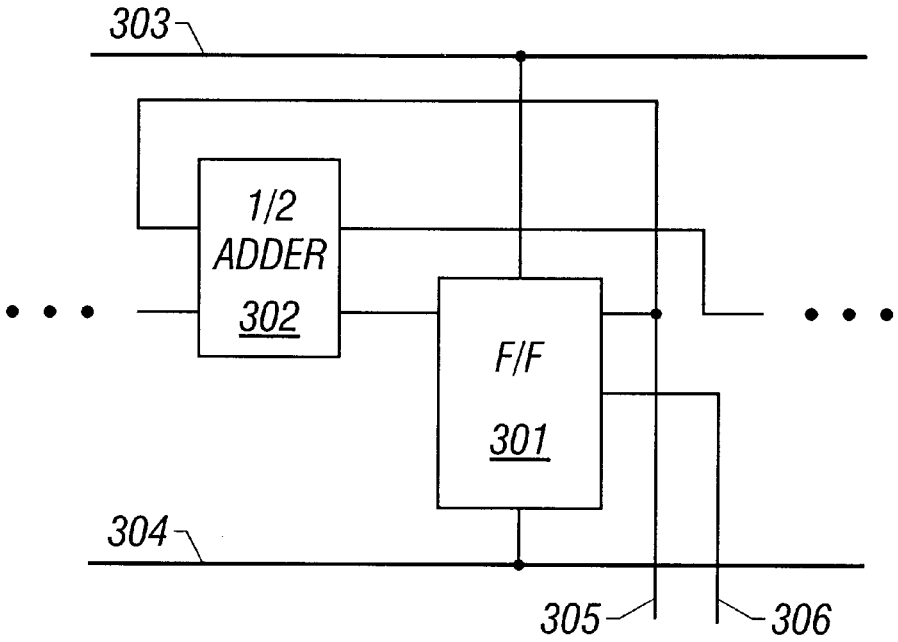
FIG. 3 shows the configuration of a counter circuit.
Figure 4:
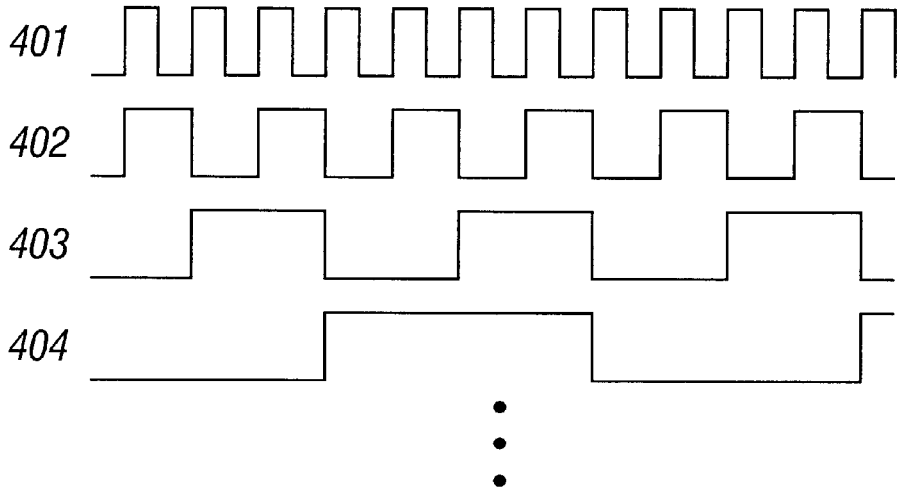
FIG. 4 shows the operation of the counter circuit of FIG. 3.

FIG. 3 shows the configuration of each counter circuit. In FIG. 3, reference numeral 301 denotes a flip-flop circuit; 302, a half adder circuit; 303, an inverted clock signal line; 304, a clock signal line; 305, an output line; and 306, an inverted output line. FIG. 4 shows the operation of this counter circuit. In FIG. 4, reference numeral 401 denotes a clock signal, and 402–404 denote output signals of first to third stages, respectively.

The scanning line decoder 106 is a logic circuit for selecting a particular scanning line in response to a count signal, and outputs n scanning line signals each of which is supplied to the gates of n-channel thin-film transistors 603 of the pixels (see FIG. 6) connected in parallel to the scanning line concerned.

Unlike the conventional device, each of the signal line counter 102 and the signal line decoder 103 is divided into an arbitrary number of sections so that the power consumption is reduced. In the configuration of this embodiment, this number is selected from an approximate range of 10 to 20 based on experimental results; for example, it is set at 16. Further, a signal line clock selector 101 is provided to input a signal line clock signal to the respective sections only when it is necessary. The signal line clock selector 101 is constructed as shown in FIG. 2.

Figure 2:
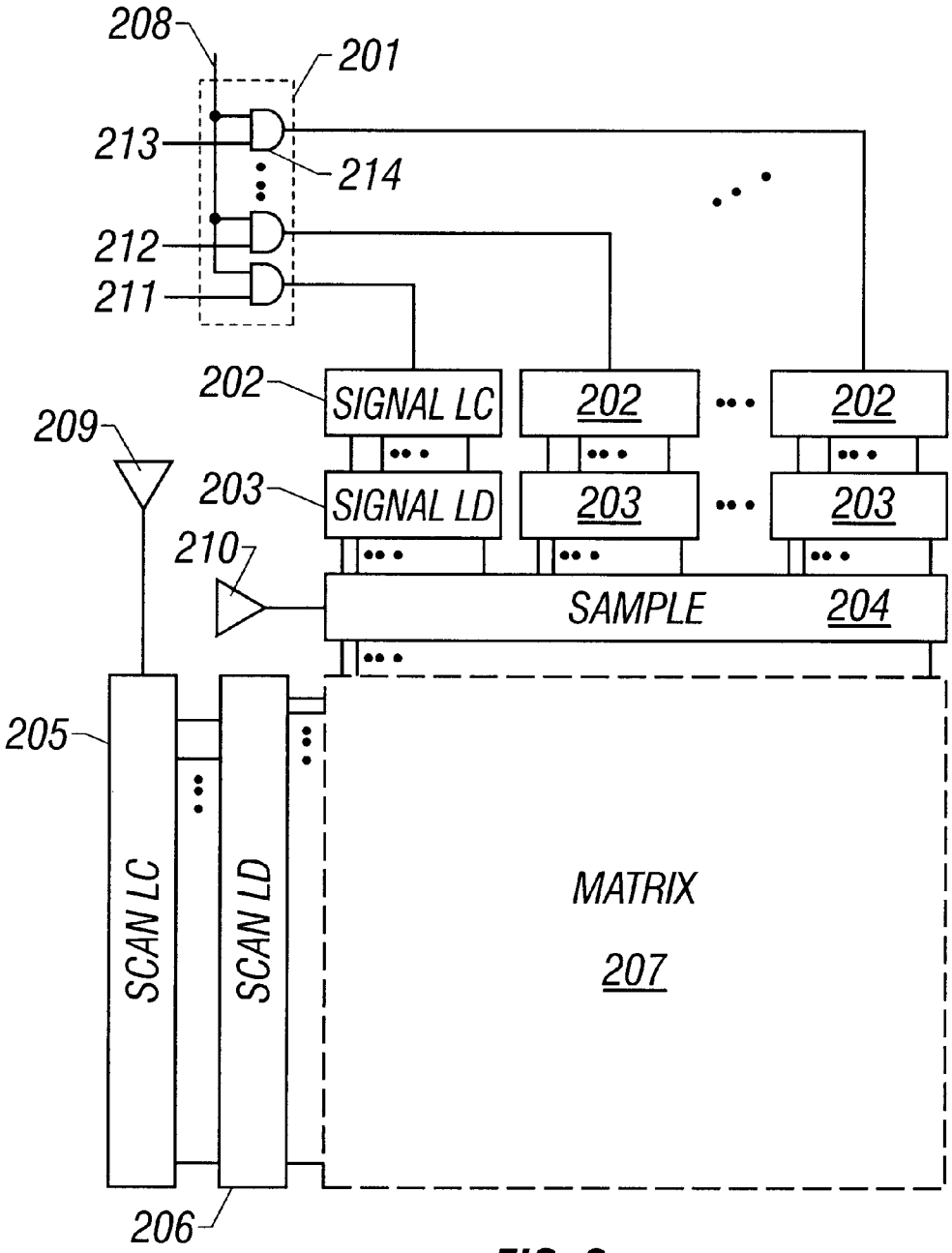
FIG. 2 shows the configuration of a signal line clock selector.

In FIG. 2, reference numeral 202 denotes each signal line counter section; 203, a signal line decoder section; 204, a signal line sampling circuit; 205, a scanning line counter; 206, a scanning line decoder; 207, a pixel matrix portion; 209, a scanning line clock signal; 210, a video signal; 211, a first signal line section select signal; 212, a second signal line section select signal; and 213, a final signal line section select signal.

As shown in FIG. 2, a signal line clock selector 201 consists of 16 AND circuits 214. A signal line clock signal 208 is input to one input terminal of each AND circuit 214 and the select signal 211, 212 or 213 is input to the other input terminal.

The operation of the matrix-type display device of the first embodiment will be described below.

First, a description will be made of an operation of displaying one line, that is, pixels connected to a single output line of the scanning line decoder 206.

Attention is paid to the k-th line from the top in the vertical direction (hereinafter referred to simply as "k-th line"). When the output of the scanning line decoder 206 for the k-th line turns a high potential (hereinafter abbreviated as "H"), the gate electrodes of all the k-th line pixels receive "H" and hence source-drain conduction is established in all the n-channel thin-film transistors 603 of the k-th line.

During the course of the above operation, first, the first signal line section select signal 211 turns "H" and the other signal line section select signals become "L." Therefore, the signal line clock selector 201 supplies the signal line clock signal 208 to the leftmost signal line counter section 202 and outputs "L" to the other sections. Whereas the first signal counter section counts up in response to the signal line clock signal 208, other sections do not operate and hence do not consume power. After completion of the count-up of the leftmost signal line counter section, the next signal line section select signal 212 turns "H" and other signal line section select signals become "L." The above operation is repeated until the final signal line section select signal 213 turns "H" and the other signal line section select signals become "L." On the other hand, according to an output, the video signal 210 is sampled by the signal line sampling circuit 204, and display signals are sequentially written to the respective pixels. Thus, a one-line writing operation is finished.

Next, a description will be made of an operation of displaying one frame.

As the scanning line counter 205 counts up in synchronism with the scanning line clock signal 209, scanning lines are sequentially selected from the top of one frame by the scanning line decoder 206 and are given an output "H." The above-described one-line display is effected when the gate signal of each line is "H." One frame is displayed in this manner.

In the matrix-type display device having the above configuration, the power consumption as well as the amount of heat generation can be reduced in the signal line driver portion.

Figure 16:
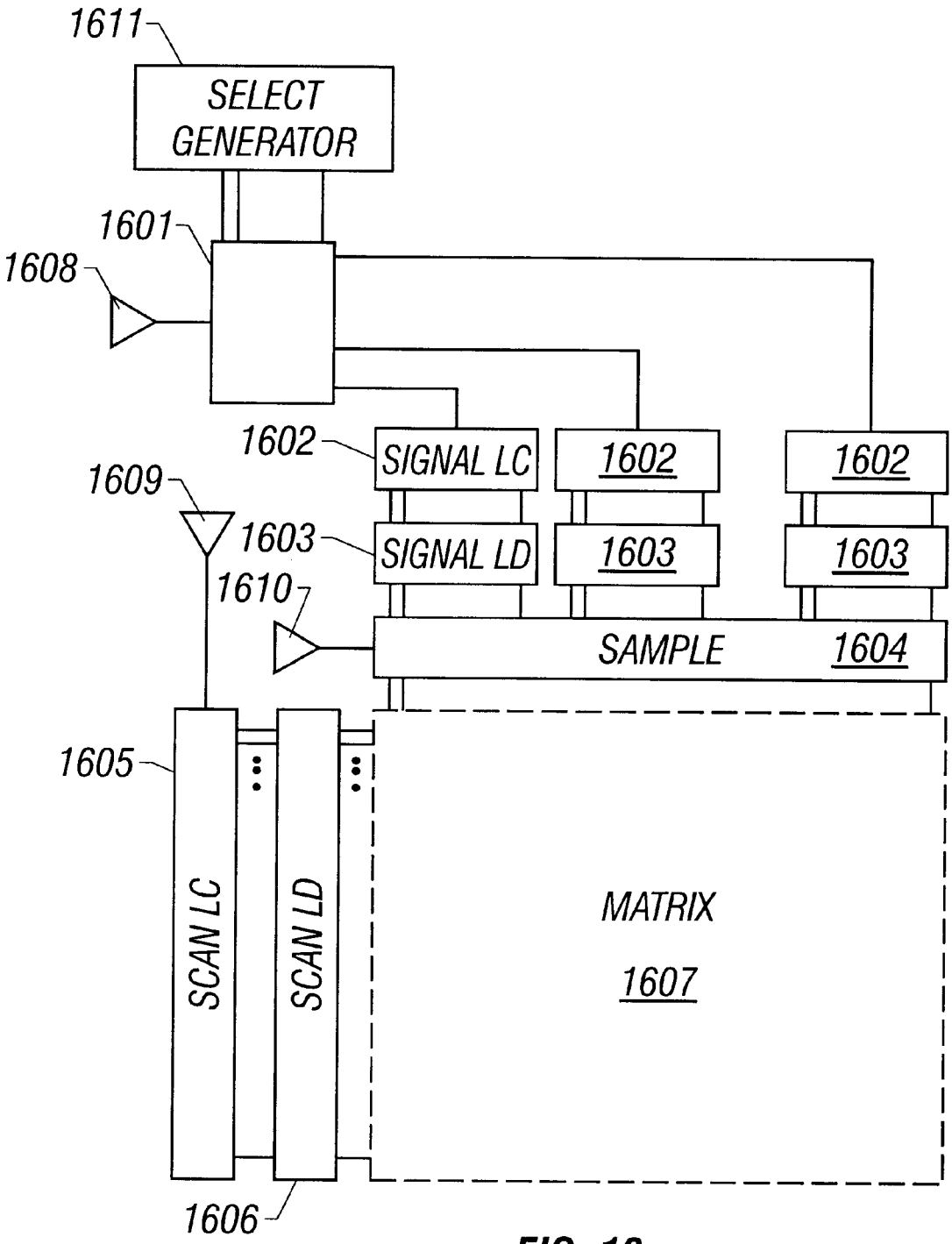
FIG. 16 shows the configuration of another matrix-type display device according to the first embodiment which incorporates a select signal generation circuit.
Figure 17:
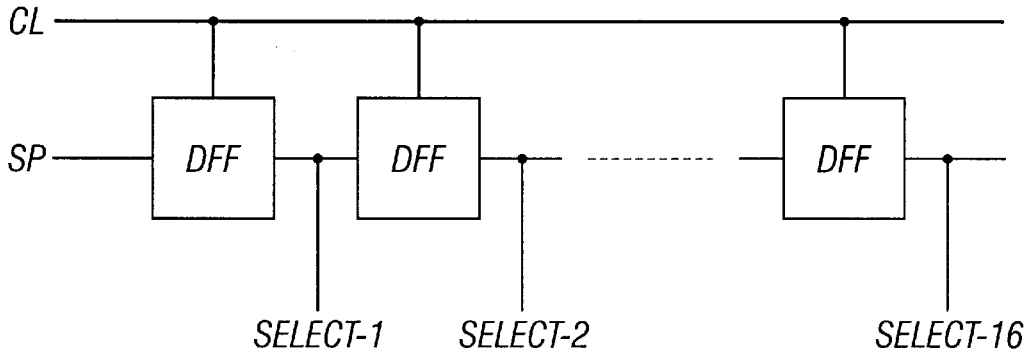
FIG. 17 shows the configuration of an example of the select signal generation circuit.

FIG. 16 shows a configuration that incorporates a select signal generation circuit. In FIG. 16, reference numeral 1601 denotes a signal line clock selector; 1602, signal line counter sections; 1603, signal line decoder sections; 1604, a signal line sampling circuit; 1605, a scanning line counter; 1606, a scanning line decoder; 1607, a pixel matrix portion; 1608, a signal line clock signal; 1609, a scanning line clock signal; and 1610, a video signal. By forming a select signal generation circuit 1611 for generating a select signal for controlling of the selector 1601 on a pixel substrate by using thin-film transistors as shown in FIG. 16, the number of input terminals to be formed on the pixel substrate can be reduced. The select signal generation circuit 1611 can be easily constructed by using such circuits as shift registers, ring counters, or multiplexers. FIG. 17 shows an example in which shift registers are used.

Embodiment 2

Figure 7:
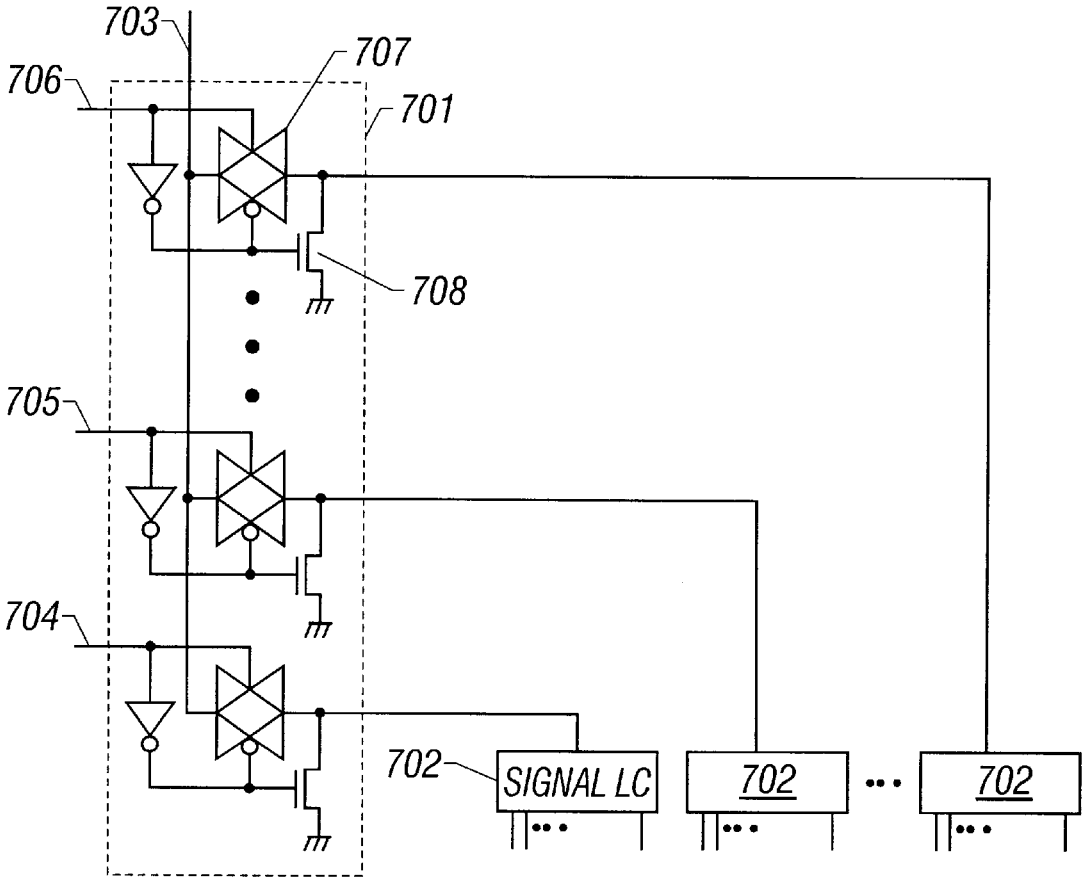
FIG. 7 shows the configuration of a signal line clock selector using analog switches according to a second embodiment of the invention.

In a second embodiment of the invention, the signal line clock selector 101 of the first embodiment is constructed by using analog switches 707 as shown in FIG. 7. In FIG. 7, reference numeral 701 denotes a signal line clock selector; 702, signal line counter sections; 703, a signal line clock signal; 704, a first signal line section select signal; 705, a second signal line section select signal; and 706, a final signal line section select signal. Each analog switch 707 outputs the signal line clock signal 703 when the corresponding signal line section select signal 704, 705 or 706 is "H." When corresponding signal line section select signal 704, 705 or 706 is "L," each analog switch 707 outputs "L" because an n-channel transistor 708 that is connected to the output of the analog switch 707 receives "H" at its gate so that source-drain conduction is established in the n-channel transistors.

The other configuration and operation of the matrix-type display device of this embodiment are the same as those of the first embodiment.

Further, as in the case of the first embodiment, the number of terminals on a pixel substrate can be reduced by forming the select signal generation circuit 1611 on the pixel substrate (see FIG. 16).

Embodiment 3

Figure 8:
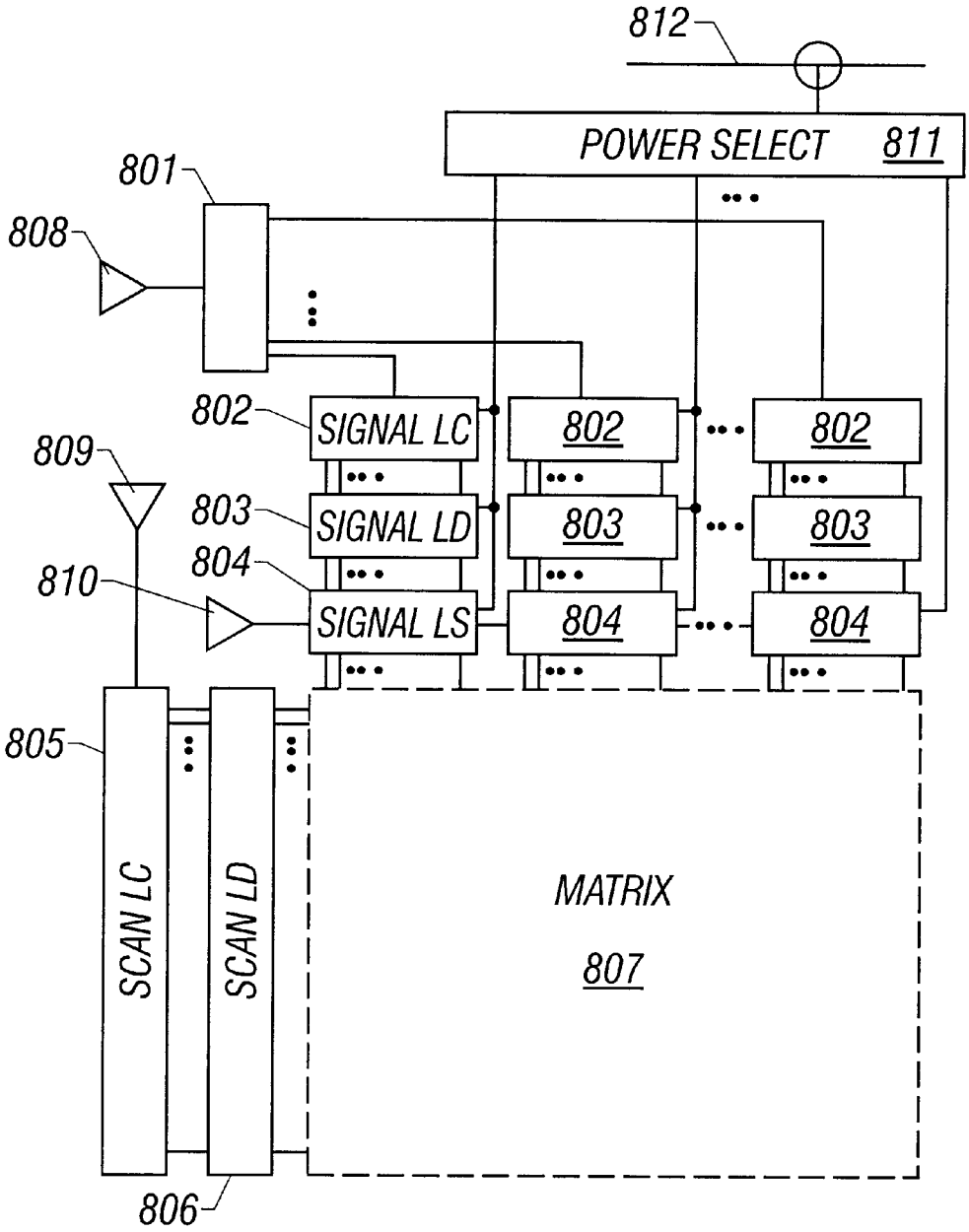
FIG. 8 shows the configuration of a matrix-type display device according to a third embodiment of the invention.

FIG. 8 shows the configuration of a matrix-type display device according to a third embodiment of the invention. In FIG. 8, reference numeral 807 denotes a pixel matrix portion; 809, a scanning line clock signal; 810, a video signal; and 812, a power line.

In the first and second embodiments, the signal line counter sections 102 or 702 that are not selected by the selector 101 or 701 are always supplied with a power supply voltage. In contrast, in the third embodiment, a signal line driver power selector 811 is provided to prevent the power supply voltage from being input to the circuit sections which are not receiving a signal line clock signal. The signal line driver power selector 811 is constructed in the same manner as the signal line clock selector 101 of the first embodiment or the signal line clock selector 701 of the second embodiment.

Further, in this embodiment, a signal line sampling circuit 804 is also divided into sections in the same manner as the signal line counter 102 and the signal line decoder 103 of the first embodiment and the signal line counter 702 and the signal line decoder 703 of the second embodiment. A power supply voltage that is output in parallel from the signal line driver power selector 811 is supplied to all of a signal line counter section 802 that is selected by a selector 801 for a signal line clock signal 808, and a signal line decoder section 803 and a signal line sampling circuit section 804 that are connected in series to the selected signal line counter section 802.

The other part of the configuration of this embodiment is similar to those of the first and second embodiments.

In operation, the signal line driver power selector 811 does not supply a power supply voltage to signal line counter sections 802 to which the signal line clock signal 808 is not input, and signal line decoder sections 803 and signal line sampling circuit sections 804 in which no variations occur in output signals because they are connected to the signal line counter sections 802 to which the signal line clock signal 808 is not input. The other part of the operation of this matrix-type display device is similar to that of the first and second embodiments.

Further, as in the case of the first embodiment, the number of terminals on a pixel substrate can be reduced by forming the select signal generation circuit 1611 on the pixel substrate (see FIG. 16).

Embodiment 4

Figure 9:
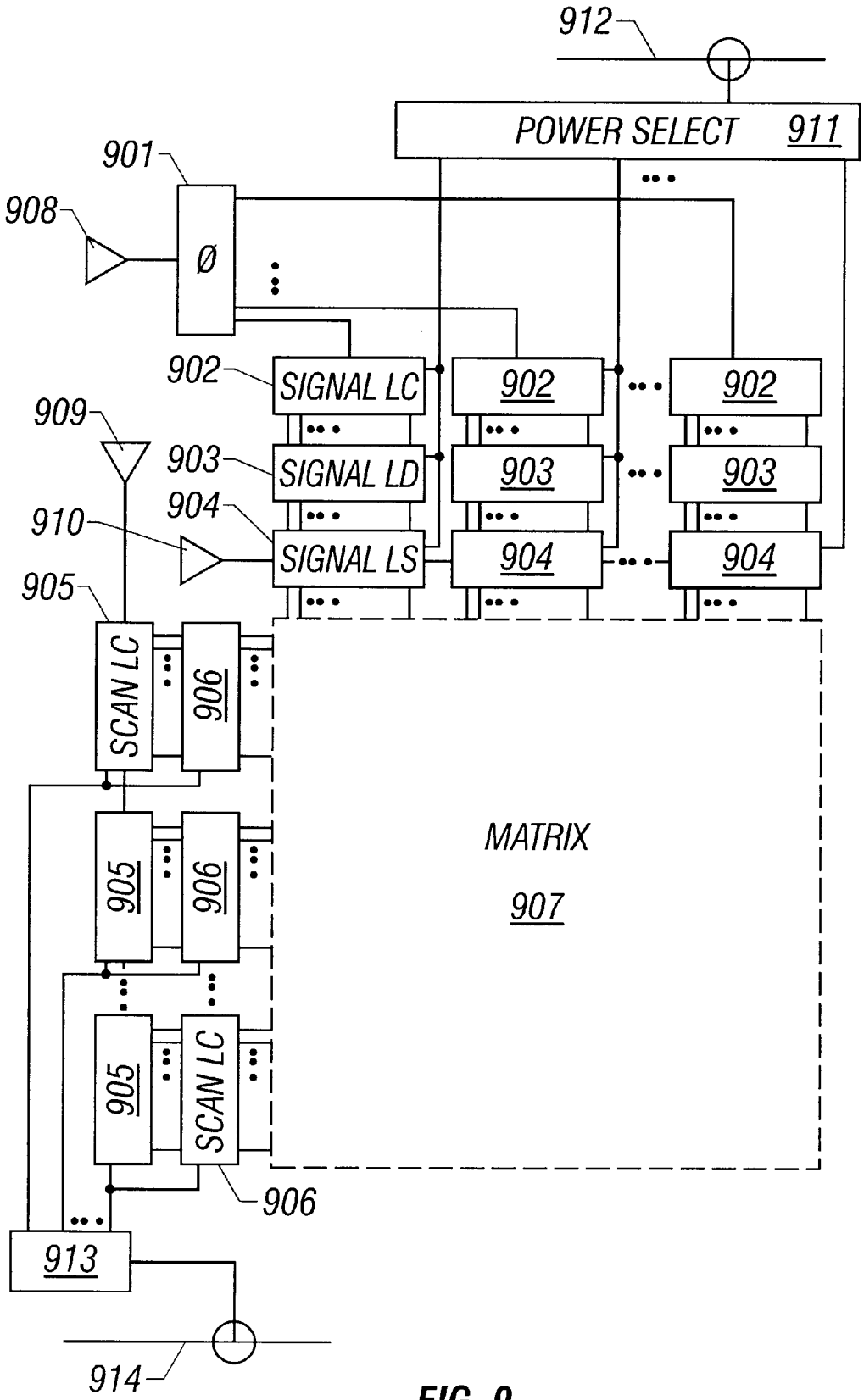
FIG. 9 shows the configuration of a matrix-type display device according to a fourth embodiment of the invention.

FIG. 9 shows the configuration of a matrix-type display device according to a fourth embodiment of the invention. In FIG. 9, reference numeral 901 denotes a signal line clock selector; 902, signal line counter sections; 903, signal line decoder sections; 904, signal line sampling circuit sections; 907, a pixel matrix portion; 908, a signal line clock signal; 909, a scanning line clock signal; 910, a video signal; 911, a signal line driver power selector; and 912 and 914, power lines.

This embodiment is configured such that the scanning line counter 805 and the scanning line decoder 806 of the third embodiment (see FIG. 8) are also divided into an arbitrary number of section in the same manner as in the signal line driver of the first to third embodiments. Further, this embodiment is provided with a scanning line driver power selector 913, whose circuit configuration is the same as the signal line driver power selector 811 of the third embodiment (see FIG. 8). An output of the scanning line driver power selector 913 is supplied in parallel to both of the series-connected scanning line counter section 905 and scanning line decoder section 906.

The other part of the configuration of this matrix-type display device is similar to that of the third embodiment.

Further, as in the case of the first embodiment, the number of terminals on a pixel substrate can be reduced by forming the select signal generation circuit 1611 on the pixel substrate (see FIG. 16).

The operation of the above-configured device will be described below. The one-line operation is the same as in the third embodiment. The scanning line driver power selector 913 sequentially selects a scanning line counter section 905 and a scanning line decoder section 906 from the top of one frame. As the scanning line counter 905 counts up in synchronism with the scanning line clock signal 909, the scanning line decoder 906 selects a scanning line from the top of a selected scanning line section of one frame and produces an output signal "H."

A frame portion corresponding to one scanning line section is displayed by effecting the one-line display when the gate signal of each line is "H." One frame is displayed by repeating this operation for the respective scanning line sections.

Embodiment 5

Figure 5A:
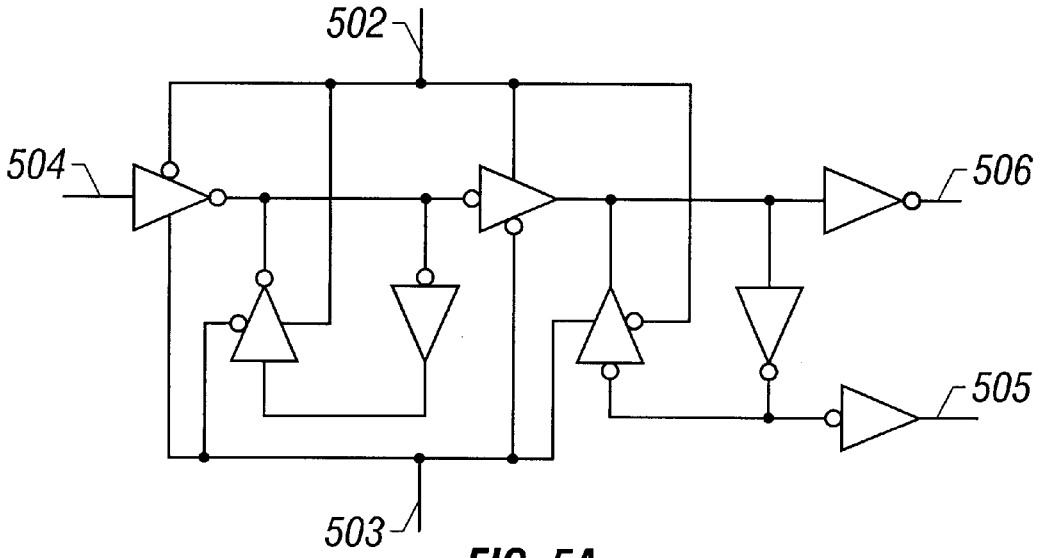
FIGS. 5A and 5B show the configuration of a flip-flop circuit.
Figure 5B:
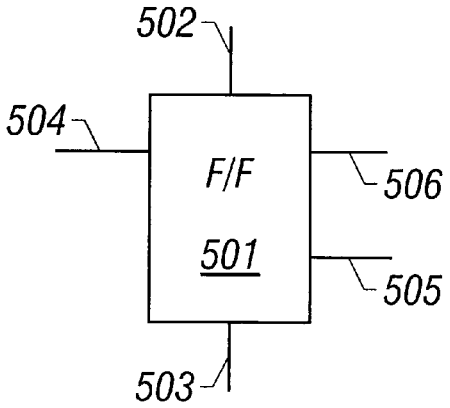
Figure 10A:
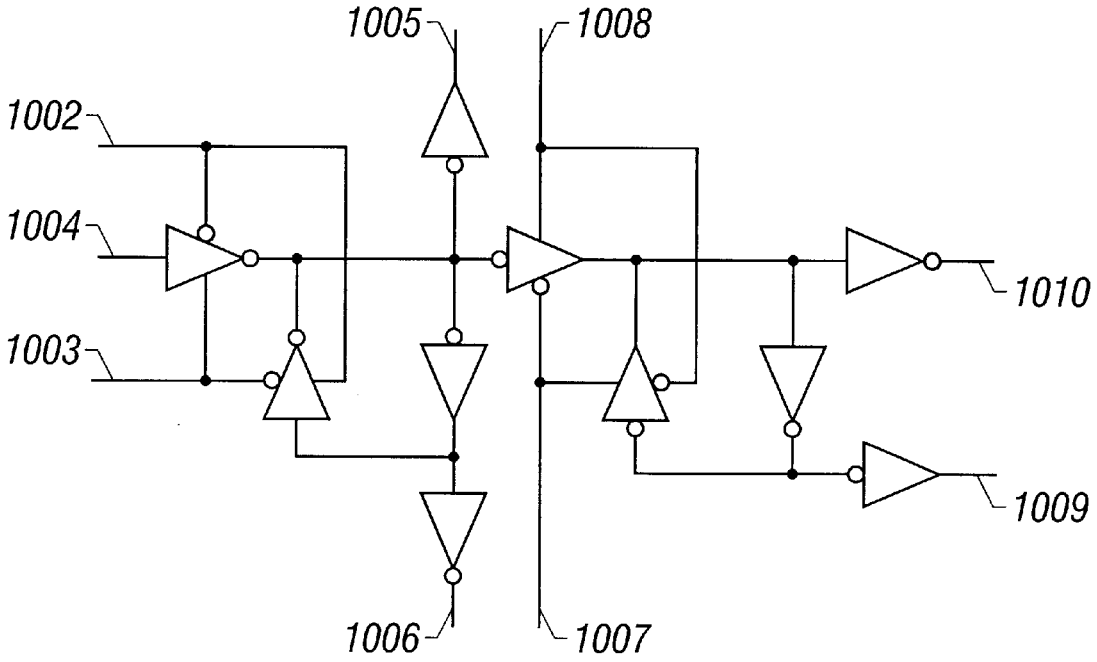
FIGS. 10A and 10B show the configuration of a flip-flop circuit used in a counter circuit according to fifth and sixth embodiments of the invention.
Figure 10B:
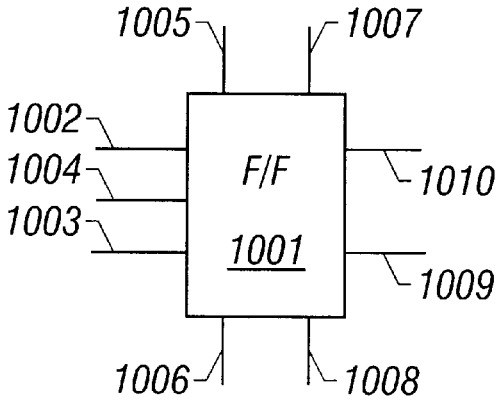
Figure 11:
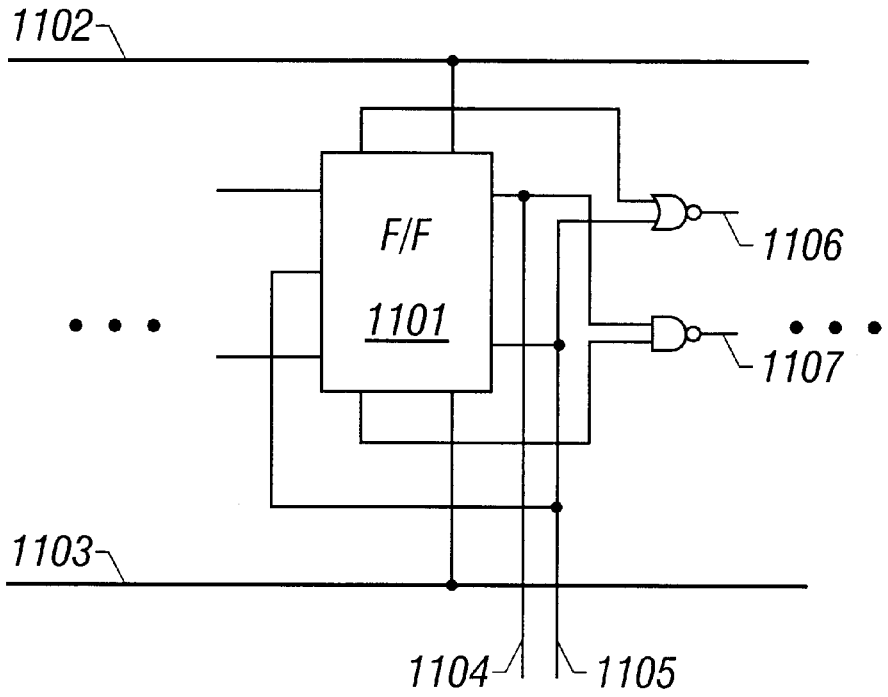
FIG. 11 shows the configuration of the counter circuit of the fifth embodiment.

In this embodiment, a counter circuit shown in FIG. 11 is constructed by using a flip-flop circuit shown in FIGS. 10A and 10B instead of forming the counter circuit of FIG. 3 by using the flip-flop circuit of FIGS. 5A and 5B as in the cases of the first to fourth embodiments.

FIGS. 10A and 10B show the configuration of the flip-flop circuit. In Figs. 10A and 10B, reference numeral 1001 denotes a flip-flop circuit; 1002, an inverted clock input line to the first half circuit; 1003, a clock input line to the first half circuit; 1004, a data input line; 1005, an output line from the first half circuit; 1006, an inverted output line from the first half circuit; 1007, an inverted clock input line to the second half circuit; 1008, a clock input line to the second half circuit; 1009, an output line from the second half circuit; and 1010, an inverted output line from the second half circuit.

FIG. 11 shows the configuration of the counter circuit. In FIG. 11, reference numeral 1101 denotes a flip-flop circuit; 1102, an inverted clock signal line; 1103, a clock signal line; 1104, an output line; 1105, an inverted output line; 1106, an inverted clock output line to the first half of the next-stage flip-flop circuit; 1107, a clock output line to the first half of the next-stage flip-flop circuit. When used in the counter circuit of FIG. 11, the flip-flop circuit of FIGS. 10A and 10B controls data acquisition of the first half circuit by the lines 1002 and 1003, and outputs are produced at the lines 1005 and 1006. Further, clock signals are input to the lines 1007 and 1008, and outputs of the second half circuit are produced at the lines 1009 and 1010 in synchronism with the clock signals.

Figure 12:
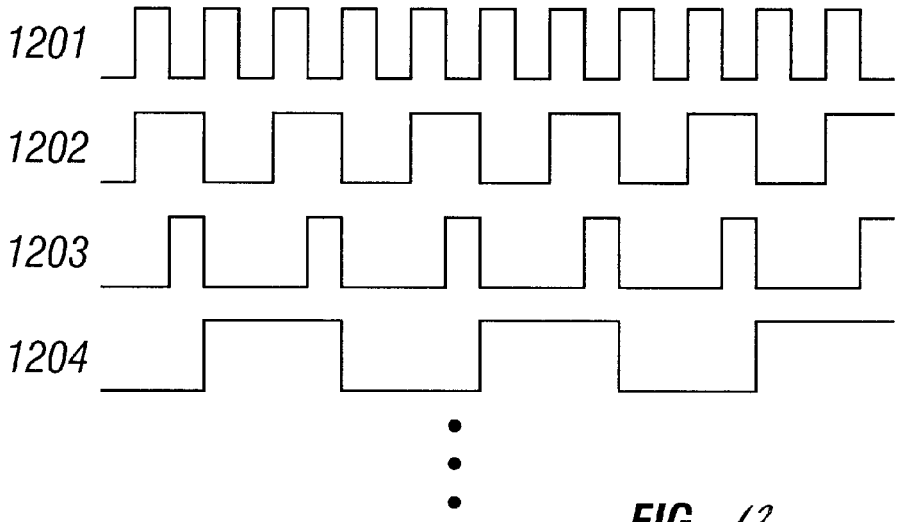
FIG. 12 shows the operation of the counter circuit of the fifth embodiment.

In this counter circuit, outputs of the pre-stage flip-flop circuit are combined by a logic circuit into signals 1106 and 1107 for controlling data acquisition of the first half of the flip-flop circuit of the stage concerned. With this configuration, the number of clocks of a clock input signal 1203 is substantially made small, so that the number of operations and the power consumption of the first half circuit can be reduced. FIG. 12 shows the operation of the counter circuit of this embodiment. In FIG. 12, reference numeral 1201 denotes a clock signal; 1202, an output signal of the first stage; 1203, a clock output signal to the first half of the second stage flip-flop circuit; and 1204, an output signal of the second stage.

The other part of each of the configuration and the operation of this matrix-type display device is similar to that of the first to fourth embodiments.

Further, as in the case of the first embodiment, the number of terminals on a pixel substrate can be reduced by forming the select signal generation circuit 1611 on the pixel substrate (see FIG. 16).

Embodiment 6

Figure 13:
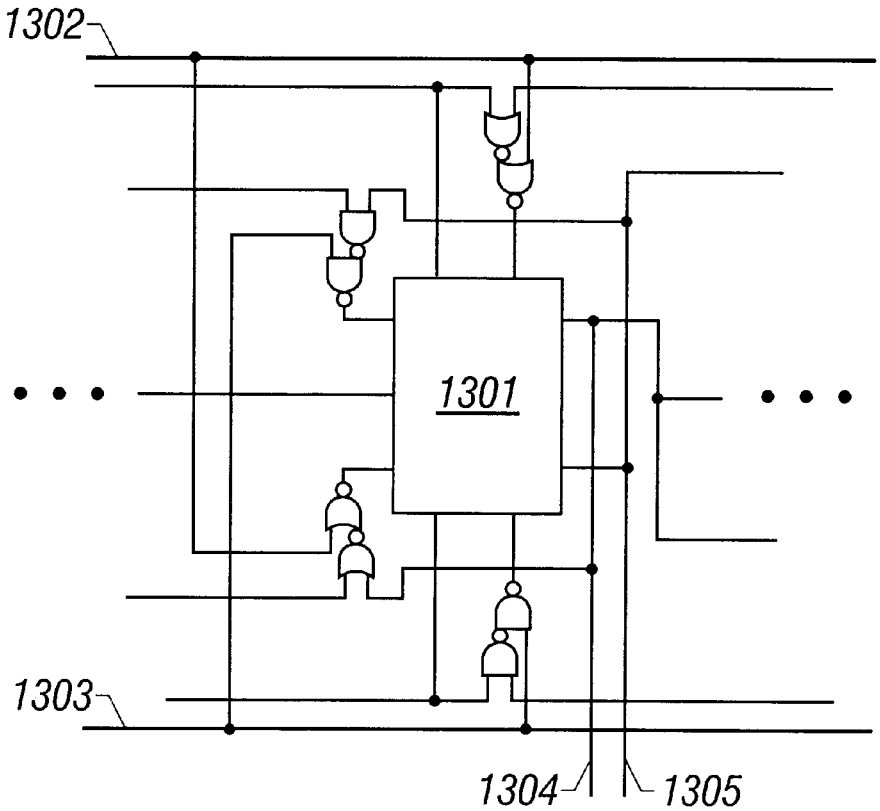
FIG. 13 shows the configuration of a shift circuit according to the sixth embodiment.

In this embodiment, a shift circuit shown in FIG. 13 is constructed by using a flip-flop circuit shown in FIGS. 10A and 10B instead of forming the combination of the counter circuit of FIG. 3 and the decoder circuit as in the cases of the first to fourth embodiments. FIG. 13 shows the configuration of a shift circuit according to this embodiment. In FIG. 13, reference numeral 1301 denotes a flip-flop circuit; 1302, an inverted clock signal line; 1303, a clock signal line; 1304, an output line; and 1305, an inverted output line.

In this shift circuit, the clock input to the first half of the flip-flop circuit of the stage concerned is controlled by the output of the second half of the pre-stage flip-flop circuit and the output of the second half of the flip-flop circuit of the stage concerned. And the clock input to the second half of the post-stage flip-flop circuit is controlled by the output of the first half of the flip-flop circuit of the stage concerned and the output of the first half of the post-stage flip-flop circuit.

In the flip-flop circuit (see FIGS. 10A and 10B) used in this shift circuit (see FIG. 13), first, the clock input to the first half of the stage concerned turns on when the output of the second half of the pre-stage turns "H." "H" is input to the first half of the stage concerned at a half clock period after that time point. When the output of the first half of the stage concerned turns "H," the clock signal input to the second half of the stage concerned turns on. Although the output of the second half of the pre-stage turns "L" at a half clock period after that time point, "H" is input to the second half of the stage concerned from the first half of the stage concerned. Since the output of the second half of the stage concerned is "H," the clock signal input to the first half of the stage concerned remains on. At a half clock period after that time point, the first half of the stage concerned acquires "L" from the second half of the pre-stage. At a half clock period after that time point, the second half of the stage concerned acquires "L" from the first half of the stage concerned. When the output of the second half of the stage concerned turns "L," the clock input signal to the first half of the stage concerned turns off.

Figure 14:
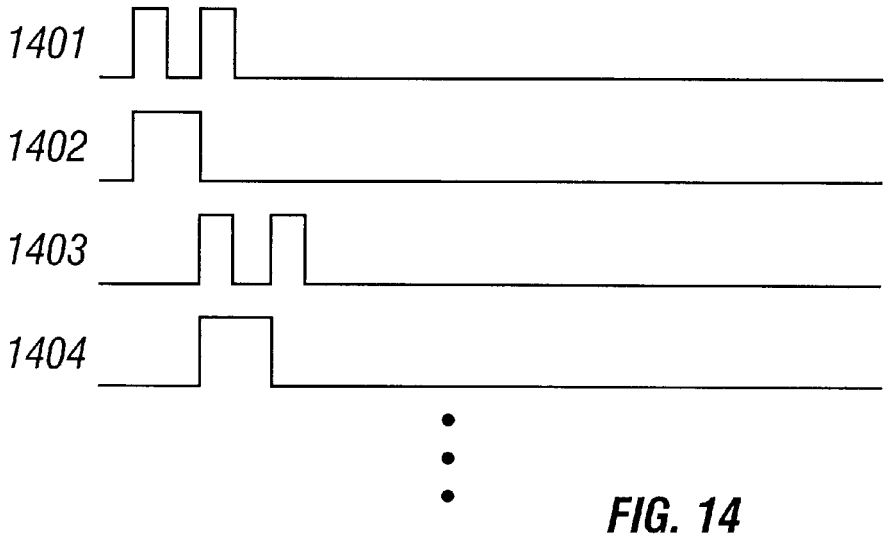
FIG. 14 shows the operation of the shift circuit of the sixth embodiment.
Figure 15:
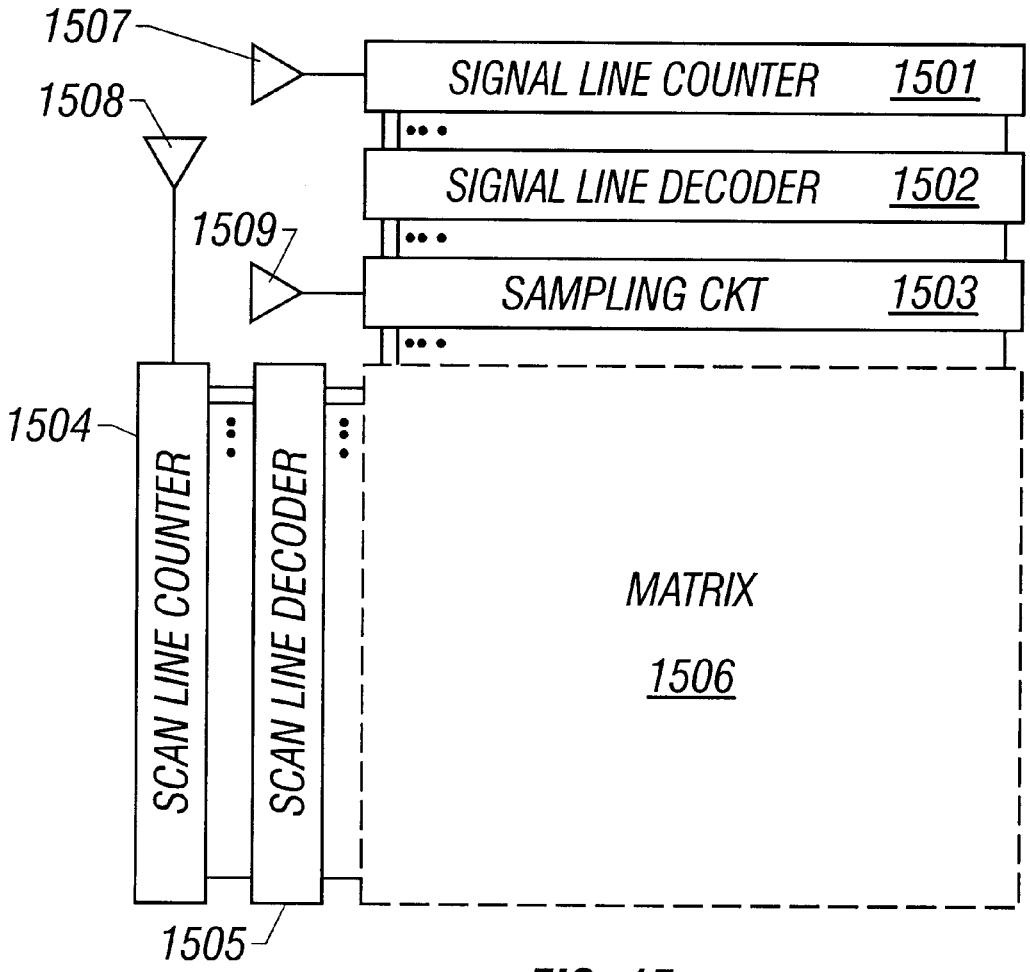
FIG. 15 shows the configuration of a conventional matrix-type display device.

As described above, clock signals 1401 and 1403, each of which has clocks of only two periods, are input to the half of each flip-flop circuit. Therefore, the number of operations and the power consumption can be reduced. FIG. 14 shows the operation of the shift circuit of this embodiment. In FIG. 14, reference numeral 1401 denotes a clock signal to an n-th stage flip-flop circuit; 1402, an output signal of the n-th stage; 1403, a clock signal to an (n+1)-th stage flip-flop circuit; and 1404, an output signal of the (n+1)-th stage.

The other part of each of the configuration and the operation of this matrix-type display device is similar to that of the first to fourth embodiments.

Further, as in the case of the first embodiment, the number of terminals on a pixel substrate can be reduced by forming the select signal generation circuit 1611 on the pixel substrate (see FIG. 16).

As described above, the invention can provide the matrix-type display device which is low in both of the power consumption and the amount of heat generation irrespective of the clock period and the power supply voltage.

What is claimed is:

1. An electro-optical device comprising:

a substrate;

a plurality of pixels arranged in a matrix overlapping said substrate;

a plurality of scanning lines formed overlapping said substrate, each of said scanning lines supplying a scanning signal to a corresponding pixel;

a scanning driver circuit formed overlapping said substrate, said scanning driver circuit including a first decoder circuit to select said scanning lines and a first counter circuit to control said first decoder circuit;

a plurality of signal lines formed overlapping said substrate, each of said signal lines supplying a display signal to a corresponding pixel;

a signal driver circuit formed overlapping said substrate, said signal driver circuit including a second decoder circuit to select said signal lines and a second counter circuit to control said second decoder circuit;

wherein at least one of said scanning driver circuit or said signal driver circuit is divided into a plurality of section circuits;

a selector for supplying a clock signal to said section circuits, wherein each of said section circuits is connected to said selector independently from one another through a respective selection line, wherein a specific section circuit receives said clock signal, where an output of one of said first or second counter circuits in said specific section circuit changes, while another specific section circuit does not receive said clock signal, where an output of one of said first or second counter circuits in said another specific section circuit does not change, and wherein said clock signal is supplied to said specific section circuit through a corresponding one of said selection lines thereto.

2. A device according to claim 1 wherein each of said first decoder circuit and said first counter circuit is divided to constitute said section circuits.

3. A device according to claim 1 wherein each of said second decoder circuit and said second counter circuit is divided to constitute said section circuits.

4. A device according to claim 1 further comprising a select signal generation circuit formed overlapping said substrate, said select signal generation circuit supplying a select signal to said selector.

5. A device according to claim 1 wherein each of said scanning driver circuit and said signal driver circuit comprises at least a thin film transistor.

6. A device according to claim 4 wherein said select signal generation circuit comprises at least a thin film transistor.

7. A device according to claim 1 wherein said signal driver circuit further comprises a sampling circuit for sampling a video signal and supplying a display signal to a respective pixel selected by said second decoder circuit, wherein said sampling circuit is divided to constitute said section circuits.

8. An electro-optical device comprising:

a substrate;

a plurality of pixels arranged in a matrix overlapping said substrate;

a plurality of scanning lines formed overlapping said substrate, each of said scanning lines supplying a scanning signal to a corresponding pixel;

a scanning driver circuit formed overlapping said substrate, said scanning driver circuit including a first decoder circuit to select said scanning lines and a first counter circuit to control said first decoder circuit;

a plurality of signal lines formed overlapping said substrate, each of said signal lines supplying a display signal to a corresponding pixel;

a signal driver circuit formed overlapping said substrate, said signal driver circuit including a second decoder circuit to select said signal lines and a second counter circuit to control said second decoder circuit;

wherein at least one of said scanning driver circuit or said signal driver circuit is divided into a plurality of section circuits;

a first selector for supplying a clock signal to said section circuits, wherein each of said section circuits is connected to said first selector independently from one another through a respective first selection line;

a second selector for supplying a power supply voltage to said section circuits, wherein each of said section circuits is connected to said second selector independently from one another through a respective second selection line, wherein a specific section circuit receives said clock signal or power supply voltage, where an output of one of said first and second counter circuits in said specific section circuit changes, while another specific section circuit does not receive said clock signal or said power supply voltage, where an output of one of said first and second counter circuits in said another specific section circuit does not change, and wherein said clock signal is supplied to said specific section circuit through a corresponding one of said first selection lines thereto and said power supply voltage is supplied to said specific circuit through a corresponding one of said second selection lines thereto.

9. A device according to claim 8 wherein each of said first decoder circuit and said first counter circuit is divided to constitute said section circuits.

10. A device according to claim 8 wherein each of said second decoder circuit and said second counter circuit is divided to constitute said section circuits.

11. A device according to claim 8 further comprising at least a select signal generation circuit formed overlapping said substrate, said select signal generation circuit supplying a select signal to at least one of said first and second selectors.

12. A device according to claim 8 wherein each of said scanning driver circuit and said signal driver circuit comprises at least a thin film transistor.

13. A device according to claim 11 wherein said select signal generation circuit comprises at least a thin film transistor.

14. A device according to claim 8 wherein said signal driver circuit further comprises a sampling circuit for sampling a video signal and supplying a display signal to a respective pixel selected by said second decoder circuit, wherein said sampling circuit is divided to constitute said section circuits.

* * * * *